US006951242B1

(12) United States Patent
Des Champs et al.

(10) Patent No.: US 6,951,242 B1
(45) Date of Patent: Oct. 4, 2005

(54) ENTHALPY HEAT EXCHANGER WITH VARIABLE RECIRCULATION AND FILTRATION

(76) Inventors: Nicholas H. Des Champs, 3095 Brughes Mill Rd., Fincastle, VA (US) 24090; Benjamin R. Tritt, 505 N. Woods Ct., Salem, VA (US) 24153

( * ) Notice: Subject to any disclaimer, the term of this patent is extended or adjusted under 35 U.S.C. 154(b) by 0 days.

(21) Appl. No.: 09/244,011

(22) Filed: Feb. 4, 1999

(51) Int. Cl.[7] ..... F24F 7/007; F24F 7/008

(52) U.S. Cl. ..... 165/54; 165/96; 165/133; 165/146; 165/164; 165/907

(58) Field of Search ..... 165/54, 96, 133, 165/146, 164, 907

(56) References Cited

U.S. PATENT DOCUMENTS

| | | | | |
|---|---|---|---|---|
| 3,948,316 A | * | 4/1976 | Souriau | 165/907 |
| 4,040,804 A | | 8/1977 | Harrison | |
| 4,101,287 A | | 7/1978 | Sweed et al. | |
| 4,108,241 A | * | 8/1978 | Fortini et al. | 165/146 |
| 4,157,929 A | | 6/1979 | Kubicek | |
| 4,172,164 A | | 10/1979 | Meyer et al. | |
| 4,359,181 A | * | 11/1982 | Chisholm | 165/907 |
| 4,377,400 A | | 3/1983 | Okamoto et al. | |
| 4,391,321 A | | 7/1983 | Thunberg | |
| 4,501,321 A | | 2/1985 | Real et al. | |
| 4,582,129 A | | 4/1986 | Yano et al. | |
| 4,911,227 A | | 3/1990 | Saito et al. | |

FOREIGN PATENT DOCUMENTS

| | | | | |
|---|---|---|---|---|
| JP | 0162256 | * | 12/1979 | 165/907 |
| SU | 253769 | * | 6/1968 | 165/146 |

* cited by examiner

*Primary Examiner*—David A. Scherbel
(74) *Attorney, Agent, or Firm*—Clyde I. Coughenour

(57) ABSTRACT

A heat exchanger for both sensible and latent energy, enthalpy, has walls or plates that extend between two air streams that also permit and assist recirculation and filtration. The walls between air streams consist of a substrate with a coating on the substrate. The coating, in combination with the substrate material original porosity, is used to control final porosity and hydrophilic/oleophilic characteristics. By control of the pore size and surface material characteristics, there can be almost a total recirculation, a recirculation of only gases (filtering out solid particles), a transfer of only moisture and heat, or a transfer of only heat. The pore size and characteristics of the coating along the path of the air streams can be varied so that different types of exchange can be obtained along the path of the air streams.

20 Claims, 3 Drawing Sheets

ENTHALPY HEAT EXCHANGER WITH VARIABLE RECIRCULATION AND FILTRATION

BACKGROUND OF THE INVENTION

1. Field of the Invention

The invention is to a heat exchanger wherein the porosity and hydrophilic/oleophilic characteristics of the plate or wall between air streams and along air streams is controlled to selectively control recirculation, heat and moisture transfer, and filtration between the air streams.

2. Description of Related Art

The conservation of energy during the ventilation and air conditioning of commercial, residential and industrial buildings is a standard procedure. It is common to transfer both heat and moisture, i.e. enthalpy transfer of both sensible and latent energy. The water vapor in air is transferred from the more humid air to the less humid air. This means that usually moisture transfer will be from warm inside air to cold outside air, during winter, and from the outside warm air to the cool inside air, during summer.

The use of various heat exchange systems and variations of each basic type are old with counter flow, cross flow, and parallel flow being the most used basic types with combinations of them also in use. The counter flow type is generally considered to be the most efficient. The spacing between the heat exchange surfaces has been controlled by various means including spacers, end securing, Sweed et al, U.S. Pat. No. 4,101,287, issued 18 Jul. 1978; side securing, Real et al, U.S. Pat. No. 4,501,321, issued 26 Feb. 1985; surface deformations, Thunberg, U.S. Pat. No. 4,391,321, issued 5 Jul. 1983, and, particles, Saito et al, U.S. Pat. No. 4,911,227, issued 27 Mar. 1990.

The transfer of both heat and moisture across heat exchange surfaces or plates is disclosed by H. Harrison in U.S. Pat. No. 4,040,804, issued 9 Aug. 1977, who uses a water permeable or deliquescent paper. Okamoto et al in U.S. Pat. No. 4,377,400, issued 22 Mar. 1983, use a paper-like material of carbon fibers and binding fibers for heat exchange and moisture transfer by diffusion of vapor molecules and capillary action. Yano et al, U.S. Pat. No. 4,582,129, issued 15 Apr. 1986, teach alternative heat transfer element structures including hygroscopic moisture transmission.

Meyer et al, U.S. Pat. No. 4,172,164, issued 23 Oct. 1979, use a hydrophilic coating or layer on an impermeable backing for moisture transfer in a rotary heat exchanger and V. Kubicek, U.S. Pat. No. 4,157,929, issued 12 Jun. 1979, teaches that a porous glass fiber structure coated with a ceramic can alternately be used in the heat exchange process.

SUMMARY OF THE INVENTION

The invention is to an improvement in heat exchangers. It can be applied to any of the common heat exchangers that have one air stream flowing adjacent another air stream with a common wall between the two. This includes the parallel, cross and counter flow types as well as combinations of them, etc. The counter flow arrangement is preferred. The counter flow arrangement combined with an integral spacing means improves the enthalpy exchange. The preferred construction consists of alternating folds of a coated-fibrous material that facilitates heat and moisture transfer from one air stream to another. The folds can be spaced apart using uniform size particles held in place by an adhesive or the coating material used to coat the fibrous substrate, or deposited hot melt beads.

By proper selection of the coating material and control of the coating thickness and pore size in the sheets or plates that make up the heat exchanger, the resistance to flow across the plate and selective material transfer across or through the plate can be controlled. The flow across or through the plate can be limited to only heat (no fluid flow), to only heat and moisture flow, to only heat and fluid flow filtering out solid particles, and to restricted or limited flow between the plates (controlled recirculation). It is possible to control the coating material, coating thickness and pore size along the plate length or flow path so that any combination of these characteristics can be produced along the length of a plate. Plates with different transfer characteristics can be manufactured for different seasons of the year and for different applications or requirements such as those associated with hospitals, residential and industrial applications. The term "pore" as used can vary from large open areas or uncoated areas, such as found in air filters, to minute recesses or passages, such as those too small to conduct air.

DESCRIPTION OF THE PREFERRED EMBODIMENTS

Figure 1:
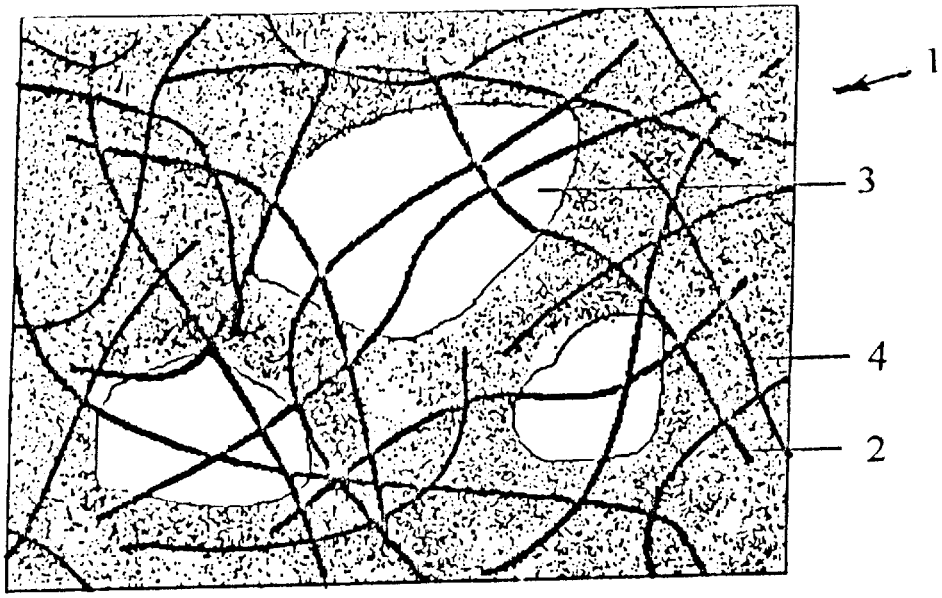
FIG. 1 is a schematic perspective view of a portion of an exchanger plate.
Figure 2:
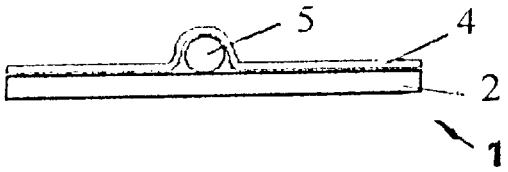
FIG. 2 is a cross-sectional view of a portion of an exchanger plate with a reinforcement.

The different characteristics of an exchanger are controlled by the materials of and structure designed into the plates. FIGS. 1 and 2 are examples of a coated substrate 1 used in the exchanger of the invention. The base material 2 has a coating 4 forming relatively large pore openings 3. A desiccant powder in the coating provides very small pores represented by the dots in the coating 4. FIG. 2 shows a reinforcement 5 between the base material 2 and the coating 4.

The base substrate can be any type of material capable of filtering including cloth, paper, natural and synthetic fibrous layers. The substrate could simply be composed of glass fibers and a binder. The filter material currently used in heating, ventilating and air conditioning (HVAC) systems to remove particulate matter from air can be used. The material is chosen for strength, compatibility with coating materials, and environmental conditions to be encountered such as temperature, acid or base vapors, etc. The preferred material has a high compression strength relative to that used in paper enthalpy exchangers. One acceptable substrate is interwoven fiberglass strands which are coated with a thin layer of resin during the spinning operation to provide a strong bond at fiber intersections. A preferred substrate is one available from Lydall Technical Papers, Grade 1871 with a composition of 3–10% acrylic latex 75–90% fiber glass, 0–15% polyester and 0–3% regenerated cellulose. To inhibit the growth of mold, mildew bacteria and fungi, either the substrate material is treated to make it antimicrobial or the coating may be blended with a small amount of biocide. The orientation and the size of fibers may be altered to control stiffness and air filtering efficiency. The substrate must be highly resistant to water damage.

Figure 3:
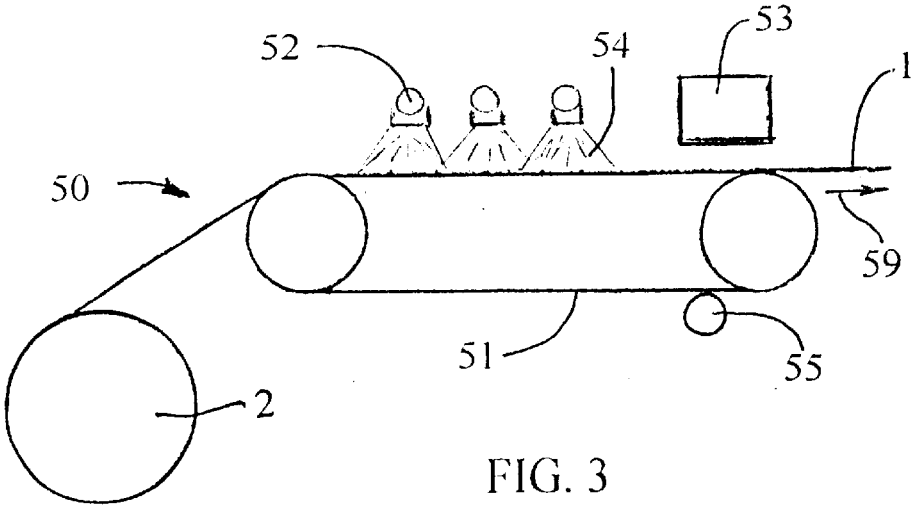
FIG. 3 is a side view of a coating machine.
Figure 4:
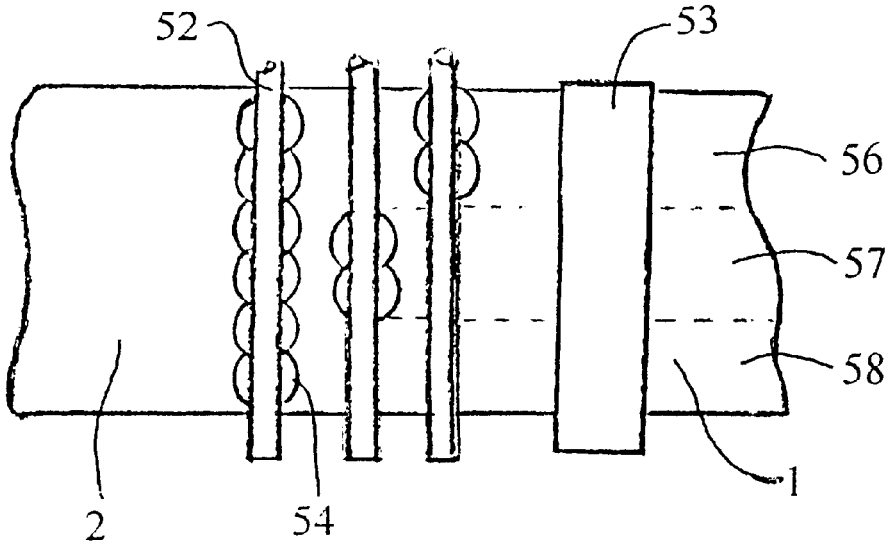
FIG. 4 is a fragmentary top view of the coating machine of FIG. 3.

FIGS. 3 and 4 depict one method by which the base material web 2 can be coated to form the coated substrate 1 used to form the exchanger 10. A roll of the base material 2 is passed 59 through a coating machine 50 over an endless conveyor belt 51 past spray 54 supplied by conduits 52 and drying means 53. The belt 51 is cleaned by a roller 55. The spray 54 is shown broadly and can have different materials sprayed on different portions of the base material. FIG. 4 shows the base material coated with one material 58 over its entire width with a second material 57 coating the central area of the web and a third material 56 coated over the upper area. To vary the thickness of one or more of the coating materials; the nozzle size can be changed, the pressure adjusted or additional nozzles used along the path through the coating machine. The different coatings 56,57,58 can be of different materials or the same materials in different ratios. Any desired area over the width of the web can be given a specific coating or remain uncoated as desired. The exchanger can be formed by folding the coated substrate back and forth along its length so that an air stream flowing across its width will be exposed to different porosities during its traverse of the exchanger.

To minimize (i.e. at least substantially preventing, precluding or rendering the substrate impervious to) the transfer of latent energy while still transferring sensible energy, a pure polyvinyl alcohol or other coating material that completely covers the substrate can be used.

If there is to be a large or total recirculation over an area, a filtering material alone can be used (i.e., no coating). A base material of the filter type may have some open areas greater than 10 microns. These are satisfactory for many applications. If there is to be moderate recirculation through an area, a selective coating can be applied to control the amount of recirculation and size of particles to be filtered from the air stream. A sporadic or otherwise incomplete coating that allows air passage can be created by spraying a light coating on the substrate, by thinning the coating mixture with water, or any other method that produces an incomplete coverage of the substrate. A light or incomplete coating can be applied to control pore or uncoated area size. As an example, the pores in the substrate for filtration can be controlled to range between 3 and 10 microns. As a thin or sporadic coating dries, small areas will be left uncovered by the coating. This will allow air to flow through the substrate media and the substrate will act as a filter by trapping over 95% of solid particles 3 microns or larger. Therefore, even with a very light coating, or even without a coating, all air that is transferred from one air stream to the other can be filtered.

When moisture and heat only are to be transferred, the preferred method to be used is to combine a desiccant with the coating and completely cover the substrate. The desiccant particles contain pores. These pores are routinely 3–100 Angstroms in diameter. The desiccant adsorbs moisture mainly based on the difference in water vapor pressure between the air and the desiccant particles. This is not true capillary attraction, although moisture transferred through the desiccant particles from one air stream or side of the wall to the other does involve some capillary action as well as diffusion and hygroscopic transmission. Although air can be adsorbed by the desiccant, the pores are so small that the air does not flow freely through the particles.

The size of the pores found in the desiccant are not related to the amount of air transferred across the heat exchanger wall. Only the pressure differential and amount or degree of the coating coverage has an effect on the amount of air transfer. A lightly coated (with small uncoated areas or "coating pores") or sporadically coated heat exchanger will allow leakage of air in proportion to the uncoated or open area exposed to the air streams. For heat and moisture transfer with limited air transfer, a sporadic coating covering with only a low percentage of open area, e.g. 10%, can be used.

The base material or substrate may be in roll form, or may be pre-pleated to the desired core configuration. The base material substrate is selectively coated with a film of water-permeable material that is hygroscopic so as to allow the transfer of heat and water between two air flows on either side of a wall formed by the substrate. Preferably the coating material is a polymer that will not dissolve in the presence of water and will withstand constant operating temperatures of up to 175° F. The coated fibrous material is to provide a relatively rigid plate structure capable of sustaining the differential pressures found in most air heat exchangers without the need for a partition plate to separate the transfer plates. By selective coating, the special requirements of various enclosures or occupied spaces can be accommodated. Recirculation with filtering can be accomplished for residential enclosures while recirculation can be avoided for medical facilities where recirculation must be avoided.

The preferred coating consists of a mixture of ceramic desiccant powder, polyvinyl alcohol polymer, water and a biocide (antimicrobial agent). A preferred dry coating can consist of 12 to 20% polymer and 80 to 88% ceramic desiccant by weight. One preferred wet mixture consists of 71% water, 25% ceramic desiccant and 4% polyvinyl alcohol by weight. The ceramic desiccant may be pure silica gel or pure molecular sieve (an artificial Zeolite type desiccant). The preferred ceramic is a mixture of silica gel and molecular sieve in powder form for ease of mixing. Silica gel powder produced by Grace Davison, 3 to 10 microns average particle size with an average pore size of 25 Angstroms, and molecular sieve produced by Grace Davison, 3 to 5 microns average particle size with a 10 Angstrom pore size, are preferred. Other possible desiccants include other molecular sieves with smaller or larger pore sizes, activated alumina, activated charcoal, clay, and calcium sulfate. Polyvinyl alcohol may be used alone as the coating. Many other polymers could potentially be used other than polyvinyl alcohol. Some of these include cross-linked polyacrylamide copolymer, polyacrylate, polyethylene glycol, polypropylene glycol, polyurethanes, nitrile-phenolics, alkyd-based resins, and water based acrylics. The different materials listed as alternatives to the polyvinyl alcohol will all act in a similar manner by coating the substrate and restricting air flow to only areas that are not completely covered. The polyvinyl alcohol, or other polymers listed above, may also act as a desiccant to adsorb and transfer water from one air stream to another.

The coating mixture can be applied to the substrate in a thin layer by spraying, brushing, dipping or rolling. After coating, the water may be removed by heating. Heating can be performed in an oven or by infrared, roller, or microwave devices. The maximum temperature used for the drying process must not exceed the degradation temperature of the polymer, e.g. of polyvinyl alcohol. The time of drying is dependent upon the amount of water present.

The percentage of water that will remain in the coating will fluctuate with operating conditions. The final coating may contain about 15% water, 75% desiccant and 10% polymer by weight. The coating should be able to withstand moisture transfer and total temporary submersion in water without any degradation during cleaning and removal of any built up dirt and dust. For high rates of leakage, the wet mixture can be altered by use of a higher percentage of water. After applying and drying the mixture, the coating will not be as thick, resulting in larger pores. The larger pores allow a greater recirculation with filtering. The percentage of excess water is essentially proportional to the decrease in coating thickness and increase in pore size.

Figure 5:
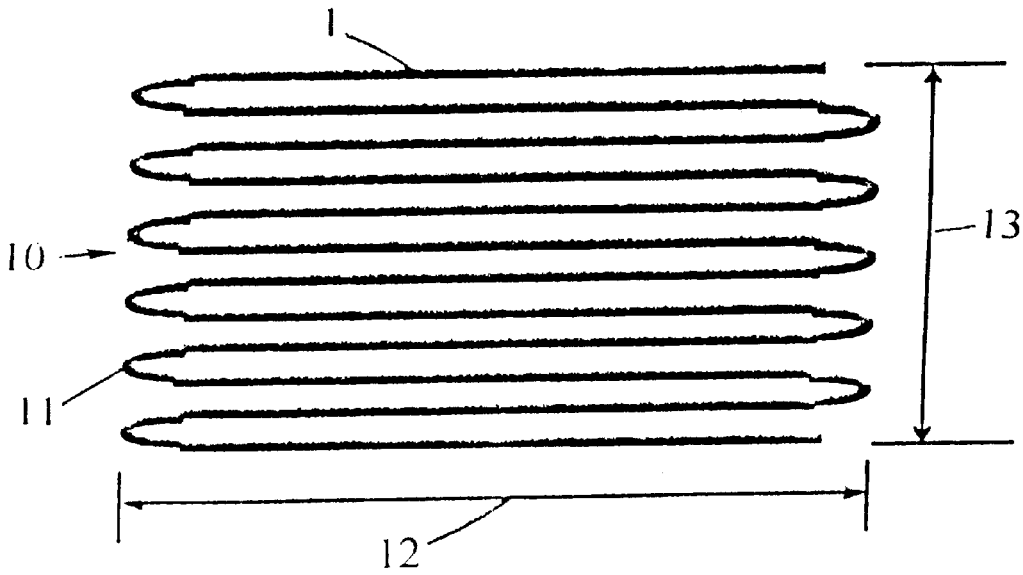
FIG. 5 is a side view of a folded, coated substrate forming an exchanger.

The coated substrate is formed into an exchanger core. The coated substrate forms plates separated for air flow between the plates. FIG. 5 is an example of a sectional end view of a continuous flow enthalpy exchanger 10. The exchanger is formed by folding 11 back and forth a coated substrate 1 to a length 12 and a height 13.

Plate separation techniques include the use of dimples, beads, inserts of corrugated material that do not extend the entire length of the heat exchanger, stiff substrate material, and reinforced substrate material. Mechanical dimpling or directly embossing a fibrous media can create a permanent spacing element between plates and is a good way to separate folded plates. Dimpling or corrugating a reinforcing material that is joined or laminated to the base substrate before coating can also serve to provide plate separation.

The use of bead separating elements can result in the least pressure drop, highest ability to withstand pressure differentials, lowest coverage of surface area and low weight. The separation beads may be located on only one side of the substrate, as long as the other side without separation means is under a positive static pressure relative to the side with separation beads. Adhesive can be used to adhere the beads to the plate or the polymer/desiccant coating can be used as an adhesive. The preferred method of plate separation is to use hot melt beads that do not require additional adhesive.

Another method of plate separation is to use a substrate that is reinforced to provide sufficient rigidity to prevent visible plate deformation during operating conditions. The stiffened plate also minimizes weight, which is inherent to some degree with beads and more so with inserts, and little or no additional pressure drop is incurred through the core with reinforced or stiffened plates. The reinforcement may consist of filter material pleated with a stiff mesh. The mesh may consist of metal wire, similar to chicken wire, plastic material or a composite structure. The metallic mesh can be imbedded in the filter material, or can be on one side of it. The polymer/desiccant coating can be used to reinforce the plate. If metal is used, it must not react with water or with the coating.

If the exchanger core is of the folded construction type, there is no need for sealing along the folds of the fibrous material. The seals on the sides, perpendicular to the folds, can be achieved by a suitable sealant or adhesive, such as silicone or a polyurethane. The strength of the adhesive seals can be supplemented by a metallic or polymer clip fastened after the sealant is applied to the joint, or can be added independently of the sealant.

Height, length and width of the core can vary as required by the installation. It is preferred that the width of the material be at least 2 times the length of the folds. In the preferred orientation, the length of the folds will be 3" to 4", the width of the material will usually be either 12", 24", or 36", for convenience of material acquisition. As a preferred embodiment for residential applications, the height of the stacked plates should be limited so that the entire core, case and unit may fit between the studs of standard construction, which are usually spaced on 16 inch centers. In this instance, the core will usually be 13" to 14" in height.

Performance of the enthalpy exchanger can be varied with different coatings to have both latent and sensible energy transfer with no recirculation and no filtering or moderate recirculation and filtering or high recirculation and filtering. The amount of moisture transfer can be varied by altering the composition of the mixture. Increasing and decreasing the amount of polymer and ceramic material will alter the degree of moisture transfer. The plate spacing and overall surface area of the heat exchanger directly affects the overall efficiency. The overall surface area of any heat exchanger directly affects the amount of heat transferred. Increased plate area and decreased plate spacing must be balanced against the higher pressure drop incurred across the exchanger core for a given fluid flow.

Figure 6:
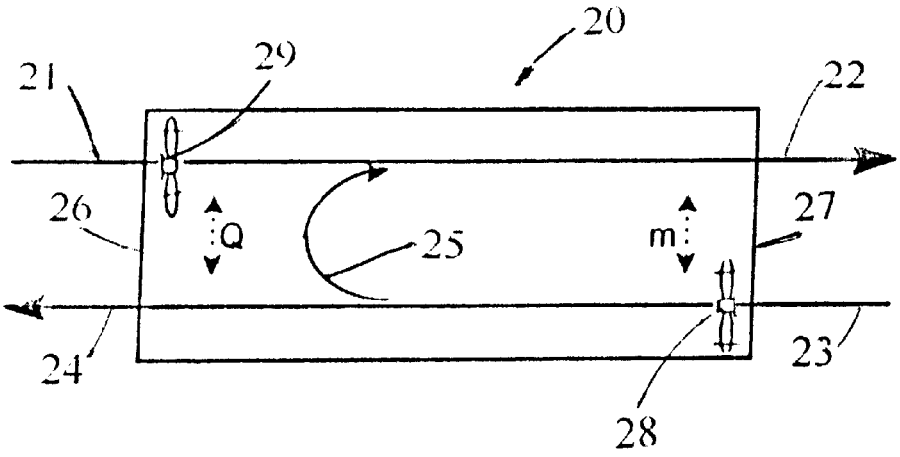
FIG. 6 is a diagram depicting heat and fluid flow within an exchanger.

FIG. 6 is an example of an exchanger unit 20 using an exchanger of the type 10 shown in FIG. 5. Both heat Q and moisture m are exchanged between outside air 21 entering one end 26 of the exchanger unit and exiting 22 at a second end 27, with inside air 23 entering at the second end 27 of the exchanger unit and exiting 24 at the first end 26 of the exchanger unit. In addition to the transfer of heat and moisture, air is shown being recirculated and filtered 25 from the exiting inside air stream to the entering outside air stream. The air can be forced through the exchanger by pressure differential creating means such as fans 28, 29. These can be controlled to selectively regulate the pressure drop across the walls or plates of the exchanger. The fans 28, 29 are shown as both forcing air into the exchanger 20. The fans directions and placements and speeds can be changed so as to control pressure differential within the enclosure. For example, fan 29 can be placed beside the second end 27 to create a partial vacuum within the enclosure air path 21, 22.

Figure 7:
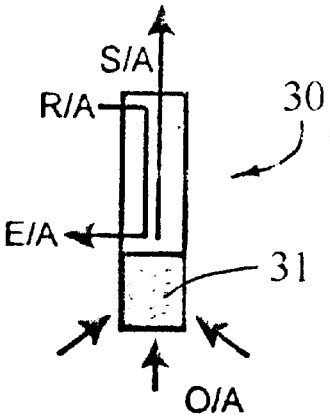
FIG. 7 is a diagram depicting a filter at the outside air entrance into an exchanger.
Figure 8:
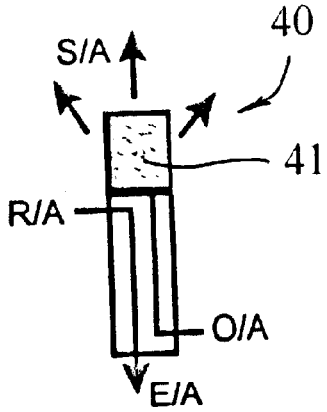
FIG. 8 is a diagram depicting a filter at the outside air outlet into a space.

FIGS. 7 and 8 depict exchangers with one exchanger unit 30 shown in FIG. 7 having a filter section 31 at the outside air entrance O/A end of the exchanger. The outside air is filtered before any heat or moisture exchange with return air R/A. The return air is eventually discharged as exhaust air E/A. After being filtered, the outside air passes by the return air for exchange between the outside air and return air. After exchange, the outside air enters into a space or enclosure as supply air S/A. FIG. 8 shows an exchanger unit 40 having a filter section 41 at the outside air O/A exit end from the exchanger. The outside air is filtered before it enters the space as supply air S/A, after heat and moisture exchange with the return air R/A. After exchange, the return air exits from the exchanger as exhaust air E/A.

As examples of use, the filtering is preferred to be at the entrance for outside air if the outside air is contaminated with dirt, dust or other undesirable particles. The filter is preferably at the supply air outlet into the enclosure or space if the outside air is clean and the enclosure air to be recirculated contains undesirable particles, or both air flows are contaminated. Filtering can take place at both ends if the enclosure and outside air are both contaminated and need to be filtered separately.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

What is claimed is:

1. An exchanger for the transfer of heat and moisture comprising:

two flow paths for air having different temperatures and moisture contents;

a common wall separating said two air flow paths and extending along said air flow paths;

said common wall having different flow-through characteristics along said air flow paths;

said different flow-through characteristics including relatively uniform but different porosity at different areas along said common wall between said air flow paths and different material means resulting in different passage between said two air flow paths for heat, moisture and solids.

2. An exchanger for the transfer of heat and moisture as in claim 1 wherein:

said wall includes a porous base material;

said different porosity includes a complete coating on said wall base material over one area, that renders said wall at least substantially impervious to the transfer of fluid, and an uncoated second area of said wall base material, that is porous to the transfer of fluid.

3. An exchanger for the transfer of heat and moisture as in claim 2 wherein:

said second area of said wall that is porous to the transfer of fluid has pores that are from 3–10 microns in size so as to transfer air through said wall second area while preventing the transfer of most solid particles.

4. An exchanger for the transfer of heat and moisture as in claim 2 wherein:

said porous base material is primarily formed from glass fibers;

said coating material is primarily formed from polyvinyl alcohol.

5. An exchanger for the transfer of heat and moisture as in claim 1 wherein:

said wall includes a porous base material;

said different porosity includes a complete coating on said wall base material over one area, that renders said wall at least substantially impervious to the transfer of fluid, and a coating over a second area on said wall base-material that includes a material having pores that are from 3 to 100 Angstroms so as to transfer moisture while preventing the transfer of other gasses and solid particles.

6. An exchanger for the transfer of heat and moisture as in claim 5 wherein:

said material with pores that are from 3 to 100 Angstroms is a desiccant to which moisture is attracted.

7. An exchanger for the transfer of heat and moisture as in claim 6 wherein:

said desiccant material is selected from the group consisting of a ceramic, clay, activated alumina, activated charcoal, and calcium sulfate.

8. An exchanger for the transfer of heat and moisture as in claim 1 wherein:

said different porosity at different areas includes a first area with relatively large pores that permit the passage of fluid but prevent the passage of most solid particles, and a second area with relatively small pores that permit the passage of moisture while preventing the transfer of solid particles and other fluids.

9. An exchanger for the transfer of heat and moisture as in claim 8 wherein:

said large pores are from 3 to 10 microns and said small pores are from 3 to 100 Angstroms.

10. An exchanger for the transfer of heat and moisture as in claim 9 wherein:

said wall includes a porous base material;

said relatively small pores are in a desiccant material in a coating on said porous base material.

11. An exchanger for the transfer of heat and moisture as in claim 8 wherein:

said different porosity at different areas include a third area with a coating that permits the transfer of heat but that is at least substantially impervious to the transfer of solids and fluids.

12. An exchanger for the transfer of heat and moisture comprising:

two flow paths for air having different temperatures and moisture contents;

a common wall separating said two air flow paths and extending along said air flow paths;

said common wall having different flow-through characteristics along said air flow paths;

said different flow-through characteristics including relatively uniform but different porosity at different areas along said common wall between said air flow paths;

said wall includes a porous substrate with a coating;

said coating provides said different-porosity at different areas;

said coating is incomplete in one area permitting circulation of air through said wall;

said coating contains a material having small pores in a second area that permits the transfer of moisture but that prevents the transfer of gasses and solid particles;

said coating is complete in a third area transferring heat but at least substantially preventing the transfer of any fluid or solid material.

13. An exchanger for the transfer of heat and moisture as in claim 12 wherein:

said material having small pores is hydrophilic and can transfer moisture from one said air flow path to the other said air flow path through said common wall by capillary attraction and diffusion while said small pores are small enough that solid particles and non-hydrophilic gasses will not pass through them under normal operating pressures.

14. A heat-exchanger with variable recirculation and filtration comprising:

a porous base web having large openings therein capable of passing gasses therethrough;

a first coating on a first area of said porous base web having no pores therein at least substantially precluding the passage of fluids therethrough;

a second coating on a second area of said porous base web having small pores therein precluding the passage of gasses but permitting the passage of a liquid.

15. A heat exchanger with variable recirculation and filtration as in claim 14 wherein:

said porous base web openings are from 3–10 microns in size;

said second coating small pores are from 3–100 Angstroms.

16. A heat exchanger with variable recirculation and filtration as in claim 14 wherein:

said porous base web material is primarily formed from glass fibers;

said first area coating is primarily formed from polyvinyl alcohol;

said second area coating is a desiccant to which moisture is attracted.

17. A heat exchanger with variable recirculation and filtration as in claim 15 wherein:

said porous base web material is primarily formed from glass fibers;

said first area coating is primarily formed from polyvinyl alcohol;

said second area coating is a desiccant to which moisture is attracted.

18. A heat exchanger with variable recirculation and filtration as in claim 16 wherein:

said second area coating desiccant is selected from the group consisting of a ceramic, clay, activated alumina, activated charcoal, and calcium sulfate that can transfer moisture from one side of said porous base web to the other side of said porous base web by capillary attraction and diffusion while said small pores are small enough that solid particles and non-hydrophilic gasses will not pass through them.

19. A heat exchanger with variable recirculation and filtration as in claim 14 wherein:

said second coating on a second area of said porous base web is a polymer containing a porous hygroscopic material selected from the group consisting of polyvinyl alcohol, polyacrylamide, polyacrylate, polyethylene glycol, polypropylene glycol, polyurethane, nitrilephenol, alkyd-based resins and water based acrylics.

20. A heat exchanger with variable recirculation and filtration as in claim 14 wherein:

said porous base web is supported by a reinforcement means.

* * * * *